US010283045B2

(12) United States Patent
Shibusawa et al.

(10) Patent No.: US 10,283,045 B2
(45) Date of Patent: May 7, 2019

(54) DISPLAY DEVICE

(71) Applicant: Japan Display Inc., Tokyo (JP)

(72) Inventors: Makoto Shibusawa, Tokyo (JP); Hiroyuki Kimura, Tokyo (JP); Tetsuo Morita, Tokyo (JP)

(73) Assignee: Japan Display Inc., Tokyo (JP)

( * ) Notice: Subject to any disclaimer, the term of this patent is extended or adjusted under 35 U.S.C. 154(b) by 91 days.

(21) Appl. No.: 15/367,426

(22) Filed: Dec. 2, 2016

(65) Prior Publication Data

US 2017/0213506 A1 Jul. 27, 2017

(30) Foreign Application Priority Data

Jan. 26, 2016 (JP) ..... 2016-012135

(51) Int. Cl.
*G09G 3/3258* (2016.01)
*G09G 3/3233* (2016.01)
*G09G 3/3266* (2016.01)

(52) U.S. Cl.
CPC ..... *G09G 3/3233* (2013.01); *G09G 3/3266* (2013.01); *G09G 2300/0819* (2013.01); *G09G 2300/0842* (2013.01); *G09G 2300/0861* (2013.01); *G09G 2310/0251* (2013.01); *G09G 2310/0286* (2013.01); *G09G 2310/08* (2013.01)

(58) Field of Classification Search
CPC ... G09G 3/3233; G09G 3/3266; G09G 3/3258
See application file for complete search history.

(56) References Cited

U.S. PATENT DOCUMENTS 8,237,639 B2 * 8/2012 Yamashita ..... G09G 3/3233 315/169.1
2005/0269959 A1 12/2005 Uchino et al.
(Continued)

FOREIGN PATENT DOCUMENTS

CN 100511373 C 7/2009
CN 100583212 C 1/2010
(Continued)

OTHER PUBLICATIONS

Taiwanese Office Action dated Oct. 3, 2017 for the corresponding Taiwanese Application No. 105133503, with partial English Translation.

(Continued)

*Primary Examiner* — Nelson M Rosario
*Assistant Examiner* — Scott Au
(74) *Attorney, Agent, or Firm* — Typha IP LLC

(57) ABSTRACT

A display device including a light emitting element, a drive transistor connected to the light emitting element, a first switching element connected to the drive transistor and a main power supply line, a second switching element connected to the drive transistor and a reset power supply line, a third switching element connected to the drive transistor and a signal line, a fourth switching element connected to the third switching element and an initialization power supply line, and a capacitor element connected to the drive transistor and the third switching element, wherein two horizontal periods ON signal is supplied to a gate terminal of each of the second switching element, third switching element and fourth switching element respectively.

13 Claims, 9 Drawing Sheets

(56) References Cited

U.S. PATENT DOCUMENTS

| | | | | |
|---|---|---|---|---|
| 2007/0152920 | A1 | 7/2007 | Yamashita et al. | |
| 2007/0273621 | A1 | 11/2007 | Yamashita et al. | |
| 2009/0201231 | A1 | 8/2009 | Takahara et al. | |
| 2010/0149079 | A1* | 6/2010 | Yamashita | G09G 3/3233 345/87 |
| 2010/0220114 | A1 | 9/2010 | Tomida | |
| 2011/0164018 | A1* | 7/2011 | Kang | G09G 3/3233 345/211 |
| 2011/0193850 | A1* | 8/2011 | Chung | G09G 3/3233 345/212 |
| 2012/0242643 | A1 | 9/2012 | Ono | |
| 2015/0187323 | A1* | 7/2015 | Jin | G09G 5/003 345/215 |

FOREIGN PATENT DOCUMENTS

| | | | |
|---|---|---|---|
| JP | 2009-276744 | A | 11/2009 |
| KR | 10-2012-0098973 | A | 9/2012 |
| TW | I409751 | B | 9/2013 |

OTHER PUBLICATIONS

Chinese Office Action dated Sep. 26, 2018 for the corresponding Chinese application No. 201611097179.2, With partial English translation.

Korean Office Action dated Nov. 30, 2018 for the corresponding Korean Patent Application No. 10-2016-0159994, with partial English translation.

* cited by examiner

DISPLAY DEVICE

CROSS REFERENCE TO RELATED APPLICATIONS

This application is based upon and claims the benefit of priority from the prior Japanese Patent Application No. 2016-012135 filed on Jan. 26, 2016, the entire contents of which are incorporated herein by reference.

FIELD

The present invention is related to a display device. In particular, the present invention is related to a circuit structure of a display device.

BACKGROUND

In recent years, the demand for high definition and narrow frames in light emitting display devices for mobile use is increasing. Display devices using a liquid crystal display device (LCD) or organic light-emitting diode (OLED) in a display part, or display devices such as electronic paper are being adopted as display devices for mobile use.

A display device using an organic EL element as described above does not require a backlight or polarization plate which are necessary in liquid crystal display devices. Furthermore, since a drive voltage of a light emitting element which is a light source is low, a display device using an organic EL element is attracting considerable attention as a low power consumption and thin light emitting display device. In addition, since a display device using an organic EL element is formed just with a thin film, it is possible to realize a display device which can be bent (flexible). Such a flexible display device does not use a glass substrate. Therefore, the flexible display device has attracted considerable attention since it is possible to realize a display device which is thin and does not break easily.

Luminance of an organic EL element is changed by a current flowing to the organic EL element. A current which flows to the organic EL element is affected by the characteristics of a thin film transistor (TFT) used in an active matrix panel. In an organic EL display device, a drive transistor is connected in series between a power supply line and an organic EL element. Therefore, the current which flows to the organic EL element is affected by variation in a threshold voltage (VTH) of the drive transistor. When the current which flows to an organic EL element is different in each pixel, display unevenness is occurred and it leads to a decrease in display quality.

Therefore, a VTH compensation circuit has been developed in order to suppress the effects on display quality by the variation in characteristics of a drive transistor. A VTH compensation is a technology for suppressing the variation in characteristics of a drive transistor by a constant current circuit for fixing a current flowing to an organic EL element.

For example, as is shown in Japanese Laid Open Patent Publication No. 2009-276744, a VTH compensation circuit can reduce the effects of a variation in characteristics of a drive transistor. Therefore, the amount of current, which is decided by input gradation data, supplied to an organic EL element is accurately controlled. Therefore, since VTH variation inherent in a drive transistor is effectively compensated, display quality of an organic EL display device is significantly improved.

However, a VTH compensation circuit requires to control a plurality of transistors which each of pixels has. Control circuits are arranged in a periphery region of the display device. Since not only signals for the transistors of the pixels of pixels but also a signal for the VTH compensation is needed, a driver circuit becomes large and thereby the area of the periphery region becomes large. As a result, the frame becomes wide.

SUMMARY

A display device according to one embodiment of the present invention includes a plurality of pixels arranged in a row direction and a column direction, each of the plurality of pixels including a light emitting element; a drive transistor having a source and drain, one of which being connected to the light emitting element; a first switching element having a source and drain, one of which being connected to the other of the source or drain of the drive transistor, and the other being connected to a main power supply line; a second switching element having a source and drain, one of which being connected to the one of the source or drain of the drive transistor, and the other being connected to a reset power supply line; a third switching element having a source and drain, one of which being connected to a gate terminal of the drive transistor, and the other being connected to a signal line; a fourth switching element having a source and drain, one of which being connected to the one of the source or drain of the third switching element, and the other being connected to an initialization power supply line; and a capacitor element having two electrodes, one electrode being connected to the one of the source or drain of the drive transistor, and the other electrode being connected to the one of the source or drain of the third switching element; wherein two horizontal periods ON signal is supplied to a gate terminal of each of the second switching element, third switching element and fourth switching element respectively.

A display device according to one embodiment of the present invention includes a plurality of pixels arranged in a row direction and a column direction, each of the plurality of pixels including a light emitting element; a drive transistor having a source and drain, one of which being connected to the light emitting element; a first switching element having a source and drain, one of which being connected to the other of the source or drain of the drive transistor, and the other being connected to a main power supply line; a second switching element having a source and drain, one of which being connected to the other of the source or drain of the drive transistor, and the other being connected to a reset power supply line; a third switching element having a source and drain, one of which being connected to a gate terminal of the drive transistor, and the other being connected to a signal line; a fourth switching element having a source and drain, one of which being connected to the one of the source or drain of the third switching element, and the other being connected to an initialization power supply line; and a capacitor element having two electrodes, one electrode being connected to the one of the source or drain of the drive transistor, and the other electrode being connected to either the source or drain of the third switching element; wherein the other of the source or drain of the first switching element and the one of the source or drain of the second switching element are connected to the reset power supply line via a fifth switching element; and two horizontal periods ON signal is supplied to a gate terminal of each of the third switching element, fourth switching element and fifth switching element respectively.

A display device according to one embodiment of the present invention includes a plurality of pixels arranged in a row direction and a column direction, each of the plurality of pixels including a light emitting element; a drive transistor including a first terminal, a second terminal and a first gate terminal, the first terminal being connected to the light emitting element; a first switching element including a third terminal, a fourth terminal and a second gate terminal, the third terminal being connected to the second terminal and the fourth terminal being connected to a main power supply line; a second switching element including a fifth terminal, a sixth terminal and a third gate terminal, the fifth terminal being connected to the first terminal and the sixth terminal being connected to a reset power supply line; a third switching element including a seventh terminal, an eighth terminal and a fourth gate terminal, the seventh terminal being connected to the first gate terminal and the eighth terminal being connected to a signal line; a fourth switching element including a ninth terminal, a tenth terminal and a fifth gate terminal, the ninth terminal being connected to the seventh terminal and the tenth terminal being connected to an initialization power supply line; and a capacitor including a first capacitor terminal and a second capacitor terminal, the first capacitor terminal being connected to the first terminal, and the second terminal being connected to the seventh terminal; wherein the third gate terminal, fourth gate terminal and fifth gate terminal are each supplied with two horizontal periods ON signal respectively.

DESCRIPTION OF EMBODIMENTS

Each embodiment of the present invention is explained below while referring to the diagrams. Furthermore, the disclosure is merely an example and a person ordinarily skilled in the art could easily arrive at appropriate modifications that maintain the concept of the invention and such modifications should be included within the scope of the present invention. In addition, although the width, thickness and shape of each component are shown schematically compared to their actual form in order to better clarify explanation, the drawings are merely an example and should not limit an interpretation of the present invention. In addition, in the specification and each drawing, the same reference symbols are attached to similar elements and elements that have been mentioned in previous drawings, and therefore a detailed explanation may be omitted where appropriate. The embodiments below aim to provide a display device which can realize a narrow frame.

First Embodiment

A summary of a display device related to one embodiment of the present invention is explained using FIG. 1 to FIG. 5. In the first embodiment, an organic EL display device arranged with a threshold compensation circuit of a drive transistor is explained.

[Structure of a Display Device 10]

Figure 1:
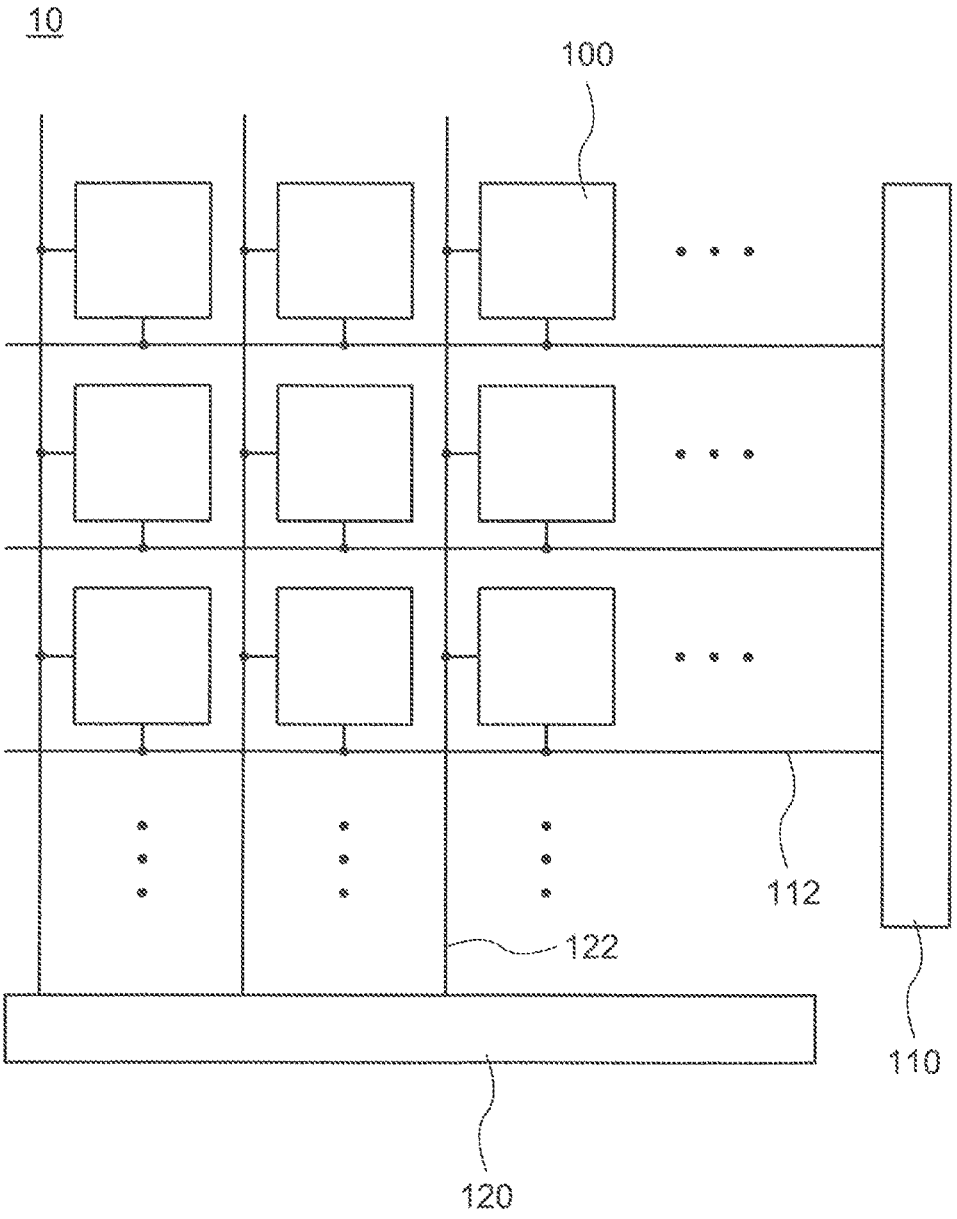
FIG. 1 is a schematic diagram showing an example of a circuit structure in a display device related to one embodiment of the present invention.

FIG. 1 is a schematic diagram showing an example of a circuit structure in a display device related to one embodiment of the present invention. As is shown in FIG. 1, in the display device 10, pixel circuits 100 are arranged in a matrix shape in n rows and m columns. Each pixel circuit 100 is controlled by a row driver 110 and a column driver 120. Here, n=1, 2, 3, . . . and m=1, 2, 3, . . . . For example, n=3 indicates a pixel circuit group arranged on a third row. m=3 indicates a pixel circuit group arranged on a third column. Although a pixel circuit group of three rows and three columns is exemplified in FIG. 1, the present invention is not limited to this form and the number of n and m is arbitrarily determined.

The row driver 110 selects a row for performing data writing. As is described later, a plurality of transistors is arranged in a pixel circuit 100 and the row driver 110 controls the plurality of transistors. In other words, a plurality of control signal lines 112 is connected to the row driver 110 and the plurality of control signal lines 112 is connected to a gate electrode (or gate terminal) of each of the plurality of transistors arranged in a pixel circuit 100. Although described in detail later, in the first embodiment, the plurality of control signal lines 112 includes an output control signal line, a pixel control signal line, a reset control signal line, an initialization control signal line and a reset power supply line. These control signal lines 112 are exclusively selected in sequence according to a certain order for each row.

The column driver 120 determines gradation based on input image data and supplies a data voltage to a pixel circuit 100 according to the determined gradation. A plurality of data signal lines 122 is connected to the column driver 120. The plurality of data signal lines 122 are connected to one of a source and drain electrode of some of the plurality of transistors arranged in a pixel circuit 100. In other words, the image data described above is supplied to a pixel circuit 100 on each column via a data signal line 122. Although described in detail later, in the first embodiment, the plurality of data signal lines 122 includes a pixel data signal line. In addition, a main power supply line and initialization power supply line extend in the same direction as the data signal line 122. Furthermore, these power supply lines may be connected to the column driver 120 the same as a data signal line 122. These data signal lines 122 supply image data or a certain voltage to a pixel circuit 100 on a row selected by the control signal line 112 described above.

Figure 2:
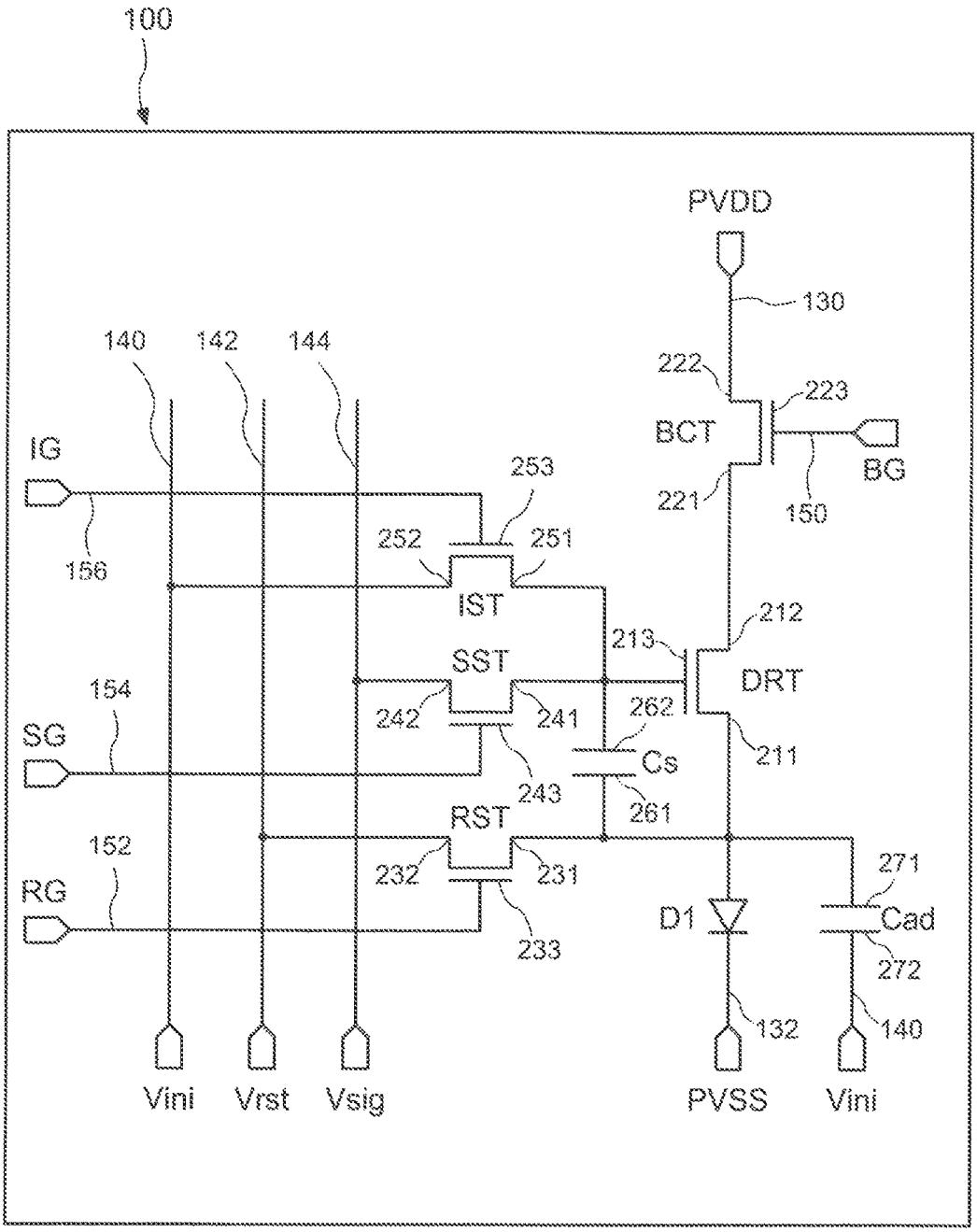
FIG. 2 is a circuit diagram showing an example of a circuit structure of a pixel circuit related to one embodiment of the present invention.

FIG. 2 is a circuit diagram showing an example of a circuit structure of a pixel circuit related to one embodiment of the present invention. All of the transistors which form the pixel circuit 100 shown in FIG. 2 are n channel type transistors. As is shown in FIG. 2, the pixel circuit 100 includes a light emitting element D1, a drive transistor DRT, an output transistor BCT, a reset transistor RST, a pixel transistor SST, an initialization transistor IST, a storage capacitor Cs, and an auxiliary capacitor Cad. In the explanation herein below, one of either a source and drain of a transistor is a first terminal and the other is a second terminal. In addition, one terminal of a capacitor element is a first capacitor terminal and the other is a second capacitor terminal.

A first terminal 211 of the drive transistor DRT is connected to an anode terminal of the light emitting element D1, a first capacitor terminal 261 of the storage capacitor Cs, and a first capacitor terminal 271 of the auxiliary capacitor Cad. A second terminal 212 of the drive transistor DRT is connected to a first terminal 221 of the output transistor BCT. A second terminal 222 of the output transistor BCT is connected to a first main power supply line 130. A first terminal 231 of the reset transistor RST is connected to the first terminal 211 of the drive transistor DRT, the first capacitor terminal 261 of the storage capacitor Cs, the anode terminal of the light emitting element D1, and the first capacitor terminal 271 of the auxiliary capacitor Cad. A second terminal 232 of the reset transistor RST is connected to a reset power supply line 142.

A first terminal 241 of the pixel transistor SST is connected to a gate terminal 213 of the drive transistor DRT, a first terminal 251 of the initialization transistor IST, and a second capacitor terminal 262 of the storage capacitor Cs. A second terminal 242 of the pixel transistor SST is connected to a pixel data signal line 144. A second terminal 252 of the initialization transistor IST is connected to an initialization power supply line 140. A second capacitor terminal 272 of the auxiliary capacitor Cad is connected to an initialization power supply line 140. In addition, a cathode terminal of the light emitting element D1 is connected to a second main power supply line 132. Here, a first main power supply line 130 and second capacitor terminal 272 of the auxiliary capacitor Cad may be connected, and a second main power supply line 132 and second capacitor terminal 272 of the auxiliary capacitor Cad may be connected.

Here, a first main power supply voltage PVDD is supplied to the first main power supply line 130. A second main power supply voltage PVSS is supplied to the second main power supply line 132. The first main power supply voltage PVDD is applied to an anode. The second main power supply voltage PVSS is applied to a cathode. An initialization power supply voltage Vini is supplied to the initialization power supply line 140. A reset power supply voltage Vrst is supplied to the reset power supply line 142. Image data Vsig is supplied to the image data signal line 144.

Furthermore, a gate terminal 223 of the output transistor BCT is connected to an output control signal line 150. A gate terminal 233 of the reset transistor RST is connected to a reset control signal line 152. A gate terminal 243 of the pixel transistor SST is connected to a pixel control signal line 154. A gate terminal 253 of the initialization transistor IST is connected to an initialization control signal line 156. An output control signal BG is supplied to the output control signal line 150. A reset control signal RG is supplied to the reset control signal line 152. A pixel control signal SG is supplied to the pixel control signal line 154. An initialization control signal IG is supplied to the initialization control signal line 156.

If the structure described above is rephrased, the first capacitor terminal 261 of the storage capacitor Cs may be connected to the first terminal 211 of the drive transistor DRT, and the second capacitor terminal 262 of the storage capacitor Cs may be connected to the first terminal 241 of the image transistor SST. In addition, although a structure in which all of the transistors which form the pixel circuit 100 are n channel type transistors is exemplified in the first embodiment, the present invention is not limited to this structure. For example, all the transistors other than a drive transistor DRT which form a pixel circuit 100 may also be a p channel type transistor, or both an n channel type and p channel type transistor. In addition, the transistors described above may also be switching elements which can be switched to an ON state and OFF state, or switching elements other than a transistor.

The output control signal line 150, reset control signal line 152, pixel control signal line 154, initialization control signal line 156 and reset power supply line 142 are included in the control signal lines 112 in FIG. 1. That is, these control signal lines and power supply lines extend in a row direction in the display device 10. On the other hand, the first main power supply line 130, initialization power supply line 140 and image data signal line 144 are included in the data signal lines 122 in FIG. 1. That is, these control signal lines and power supply lines extend in a column direction in the display device 10. Furthermore, the second main power supply line 132 is arranged in the entire surface of a substrate.

[Driving Method of the Display Device 10]

Figure 3:
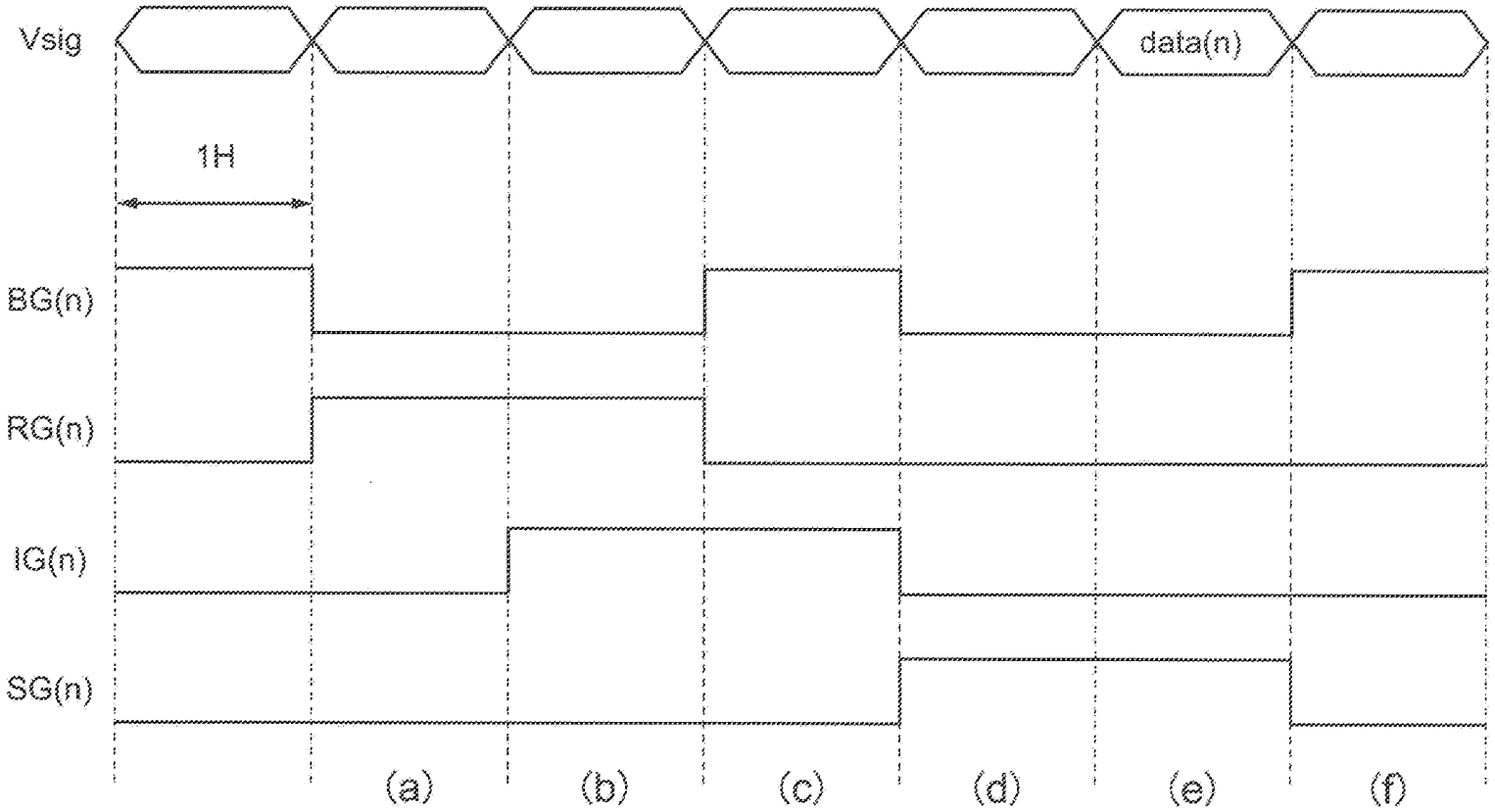
FIG. 3 is a diagram showing a timing chart illustrating a driving method of a pixel circuit related to one embodiment of the present invention.

FIG. 3 is a diagram showing a timing chart illustrating a driving method of a pixel circuit related to one embodiment of the present invention. Furthermore, in the present embodiment, all of the transistors which form a pixel circuit are n channel type transistors. That is, when a [low level] control signal is supplied to a gate terminal of a transistor, that transistor is turned OFF (non-conducting state). On the other hand, when a [high level] control signal is supplied to a gate terminal of a transistor, that transistor is turned ON (conducting state). A driving method of the display device 10 is explained below using the circuit structure in FIG. 2 and timing chart in FIG. 3. Furthermore, here an example is explained in which image data is written to an nth row pixel circuit group.

As is shown in FIG. 3, the display device 10 includes (a) a first reset period, (b) a second reset period, (c) a threshold compensation period, (d) a first writing period, (e) a second writing period and (f) a light emitting period. These periods are explained below while referring to FIG. 2 and FIG. 3. Furthermore, a period sectioned by the dotted line FIG. 3 corresponds to a horizontal period (1H). A horizontal period means a period during which an image data signal is written to all the pixel circuits on one row.

(a) First Reset Period

In a first reset period, an output control signal BG changes from a high level to a low level and the output transistor BCT changes to an OFF state. Therefore, the second terminal 212 of the drive transistor DRT is cut off from the first main power supply line 130 by the output transistor BCT. A reset control signal RG changes from a low level to a high level and the reset transistor RST changes to an ON state. Therefore, a reset power supply voltage Vrst is supplied via the reset transistor RST to the first terminal 211 of the drive transistor DRT and the first capacitor terminal 261 of the storage capacitor Cs. An initialization control signal IG and pixel control signal SG are maintained at a low level and the initialization transistor IST and pixel transistor SST are maintained in an OFF state. In other words, the gate terminal 213 of the drive transistor DRT and the second capacitor terminal 262 of the storage capacitor Cs are floating.

Here, a lower voltage than the second main power supply voltage PVSS is set as the reset power supply voltage Vrst. However, it is not always necessary that the reset power supply voltage Vrst be lower than the second main power supply voltage PVSS and may be a voltage that ensures that a current does not flow to the light emitting element D1 in the second reset period explained herein. Specifically, the reset power supply voltage Vrst may be below a voltage higher than the second main power supply voltage PVSS by the amount of the threshold voltage of the light emitting element D1. Since the types of power supply voltage necessary for driving a display device decreases if the reset power supply voltage Vrst is the same as the second main power supply voltage PVSS, there is reduction in frame narrowing or energy consumption. In addition, the reset power supply voltage Vrst may be set to become a lower voltage than a floating voltage of the gate terminal 213 of the drive transistor DRT (that is, a voltage having a possibility of being supplied to the gate terminal 213) so that the drive transistor DRT does not change to an ON state. For example, −3V is supplied as the reset power supply voltage Vrst. By the operation described above, supply of a current to the light emitting element D1 is terminated and changes to a non-light emitting state. In addition, the auxiliary capacitor Cad is charged and discharged during this period and the amount of charge stored in the auxiliary capacitor Cad becomes stable. In the first embodiment, since the second capacitor terminal 272 of the auxiliary capacitor Cad is connected to the initialization power supply line 140, a charge based on a potential difference between the initialization power supply voltage Vini and the reset power supply voltage Vrst is held in the auxiliary capacitor Cad in the first reset period. On the other hand, since the second capacitor terminal 262 of the storage capacitor Cs is floating, the storage capacitor Cs is not charged and discharged and the voltage of the second capacitor terminal 262 changes according to a change in the voltage of the first capacitor terminal 261.

(b) Second Reset Period

In the second reset period, an initialization control signal IG changes from a low level to a high level and the initialization transistor IST changes to an ON state. Therefore, an initialization power supply voltage Vini is supplied via the initialization transistor IST to the gate terminal 213 of the drive transistor DRT. A reset control signal RG is maintained at a high level and the reset transistor RST is maintained in an ON state. An output control signal BG and pixel control signal SG are maintained at a low level and the output transistor BCT and pixel transistor SST are maintained in an OFF state. That is, a reset power supply voltage Vrst is supplied to the first terminal 211 of the drive transistor DRT and the first capacitor terminal 261 of the storage capacitor Cs, and an initialization power supply voltage Vini is supplied to the gate terminal 213 of the drive transistor DRT and the second capacitor terminal 262 of the storage capacitor Cs.

Here, a voltage higher than a reset power supply voltage Vrst is supplied as the initialization power supply voltage Vini. For example, +1V is supplied as the initialization power supply voltage Vini. Therefore, since the voltage (Vini) of the gate terminal 213 changes to a high level with respect to the voltage (Vrst) of the first terminal 211 in the drive transistor DRT, the drive transistor DRT changes to an ON state. This is because a sufficiently high voltage is supplied between the gate and source of the drive transistor DRT in order to change the drive transistor DRT to ON even when variation in a threshold voltage of the drive transistor DRT is considered. In addition, a charge based on a potential difference between a reset power supply voltage Vrst and an initialization power supply voltage Vini is held in the storage capacitor Cs in this period.

As described above, the auxiliary capacitor Cad is charged and discharged in the first reset period, and the storage capacitor Cs is charged and discharged in the second reset period. That is, the auxiliary capacitor Cad and the storage capacitor Cs are charged and discharged in different reset periods respectively.

(c) Threshold Compensation Period

In a threshold compensation period, an output control signal BG changes from a low level to a high level and the output transistor BCT changes to an ON state. Therefore, the first main power supply voltage PVDD is supplied via the output transistor BCT to the second terminal 212 of the drive transistor DRT. A reset control signal RG changes from a high level to a low level and the reset transistor RST changes to an OFF state. Therefore, the first terminal 211 of the drive transistor DRT is cut off from the reset power supply line 142 by the reset transistor RST. An initialization control signal IG is maintained at a high level and the initialization transistor IST is maintained in an ON state. A pixel control signal SG is maintained at a low level and the pixel transistor SST is maintained in an OFF state.

Here, since the drive transistor DRT is in an ON state in the second reset period described above, a current supplied from the first main power supply voltage PVDD flows to the first terminal 211 from the second terminal 212 of the drive transistor DRT. The potential of the first terminal 211 increases due to this current. In addition, when a potential difference between the potential of the first terminal 211 and the potential of the gate terminal 213 reaches the threshold voltage (VTH) of the drive transistor, the drive transistor DRT changes to an OFF state.

Here, since Vini is supplied to the gate terminal 213, when the potential the first terminal 211 reaches (Vini-VTH), the drive transistor DRT changes to an OFF state. At this time, since Vini is supplied to the second capacitor terminal 262 of the storage capacitor Cs and (Vini-VTH) is supplied to first capacitor terminal 261, a charge based on VTH is held in the storage capacitor Cs. In other words, it is possible to say that in a threshold compensation period, data based on VTH of the drive transistor DRT is stored in the storage capacitor Cs. Furthermore, in order to control the light emitted by the light emitting element D1 in the threshold compensation period, it is preferred that Vini is set to satisfy the condition [(Vini−VTH)−PVSS]<[threshold voltage of light emitting element].

(d) First Writing Period

In the first writing period, an output control signal BG and an initialization control signal IG change from a high level to a low level and the output transistor BCT and initialization transistor IST change to an OFF state. Therefore, the second terminal 212 of the drive transistor DRT is cut off from first main power supply line 130 by the output transistor BCT, and the gate terminal 213 of the drive transistor DRT is cut off from the initialization power supply line 140 by the initialization transistor IST. A pixel control signal SG changes from a low level to a high level and the pixel transistor SST changes to an ON state. A reset control signal RG is maintained at a low level and the reset transistor RST is maintained in an OFF state. In this way, in the first writing period, a pixel circuit changes to a state where it is possible to supply image data Vsig to the gate terminal 213 of the drive transistor DRT. Here, in the first embodiment, image data Vsig corresponding to a pixel 100 on the present row is not supplied but image data Vsig corresponding to a pixel 100 on the previous row is supplied to an image data signal line 144 in the first writing period.

(e) Second Writing Period

In the second writing period, gradation data [data(n)] is supplied as image data Vsig to the image data signal line 144. Furthermore, the level (high level or low level) of an output control signal BG, reset control signal RG, initialization control signal IG and pixel control signal SG in the second writing period is the same as in the first writing period. In this way, gradation data [data(n)] is supplied via the pixel transistor SST to the gate terminal 213 of the drive transistor DRT and the second capacitor terminal 262 of the storage capacitor Cs.

Here, when the potential of the second capacitor terminal 262 of the storage capacitor Cs changes from Vini to Vsig, the potential of the first capacitor terminal 261 increases based on (Vsig−Vini). Specifically, since the storage capacitor Cs and auxiliary capacitor Cad are connected in series, the potential of the first capacitor terminal 261 positioned between these capacitors is expressed in the following formula (1).

$$Vs = (Vini - VTH) + (Vsig - Vini)\frac{Cs}{Cs + Cad} \tag{1}$$

Therefore, a potential difference between the potential of the first terminal 211 and a potential of the gate terminal 213 is expressed by the following formula (2). That is, when image data Vsig is supplied to the gate terminal 213, a charge based on VTH of the drive transistor DRT and image data Vsig is held in the storage capacitor Cs. In this way, the drive transistor DRT changes to an ON state based on a potential difference obtained by adding VTH of the drive transistor DRT to image data Vsig.

$$Vgs = Vsig - \left\{(Vini - VTH) + (Vsig - Vini)\frac{Cs}{Cs + Cad}\right\} \tag{2}$$

(f) Light Emitting Period

In the light emitting period, an output control signal BG changes from a low level to a high level and the output transistor BCT changes to an ON state. A pixel control signal SG changes from a high level to a low level and the pixel transistor SST changes to an OFF state. A reset control signal RG and initialization control signal IG are maintained at a low level and the reset transistor RST and initialization transistor IST are maintained in an OFF state. In this way, the drive transistor DRT provides a current based on the formula (2) described above to the light emitting element D1 among the first main power supply voltages PVDD supplied to the second terminal 212.

Here, a current (Id) flowing through the drive transistor DRT is expressed by the following formula (3). By substituting the formula (2) with the formula (3), the VTH component of the drive transistor DRT is removed, and ID changes to a current which is not dependent on VTH as is expressed in the following formula (4).

$$Id = \beta(Vgs - VTH)^2 \tag{3}$$

$$Id = \beta\left\{(Vsig - Vini)\frac{Cs}{Cs + Cad}\right\}^2 \tag{4}$$

As described above, in the light emitting period, a current with the effects of VTH of the drive transistor DRT removed is supplied to the light emitting element D1. In other words, a current compensated for VTH of the drive transistor DRT is supplied to the light emitting element D1.

As is shown in FIG. 3, in the display device 10, a high level signal of a horizontal period is supplied in each of a first reset period and second reset period. Since a first reset period and second reset period are continuous, a high level signal of two horizontal periods is supplied to the reset control signal RG. In other words, an ON signal of two horizontal periods is supplied to the gate terminal 233 of the reset transistor RST. A high level signal of a horizontal period is supplied in each of the first writing period and second writing period. Since the first writing period and second writing period are continuous, a high level signal of two horizontal periods is supplied to the pixel control signal SG. That is, an ON signal of two horizontal periods is supplied to the gate terminal 243 of the pixel transistor SST.

Although described later, in the first writing period described above, image data writing is not performed in a drive transistor DRT on the present row (nth row) but image data Vsig is written to a drive transistor DRT on the previous row (n−1 row). Although a driving method is exemplified in the first embodiment in which image data is written to a drive transistor DRT on an n−1 row in the first writing period, the present invention is not limited to this driving method. For example, image data may also be written to a drive transistor on rows other than an n−1 row. Although a driving method is exemplified in the first embodiment in which image data Vsig of a n−1 row is supplied to the image data signal line 144 in the first writing period, and gradation data [data(n)] is supplied as image data Vsig of an nth row to the image data signal line 144 in the second writing period, the present invention is not limited to this driving method.

[Circuit Structure of a Periphery Circuit in Display Device 10]

Figure 4:
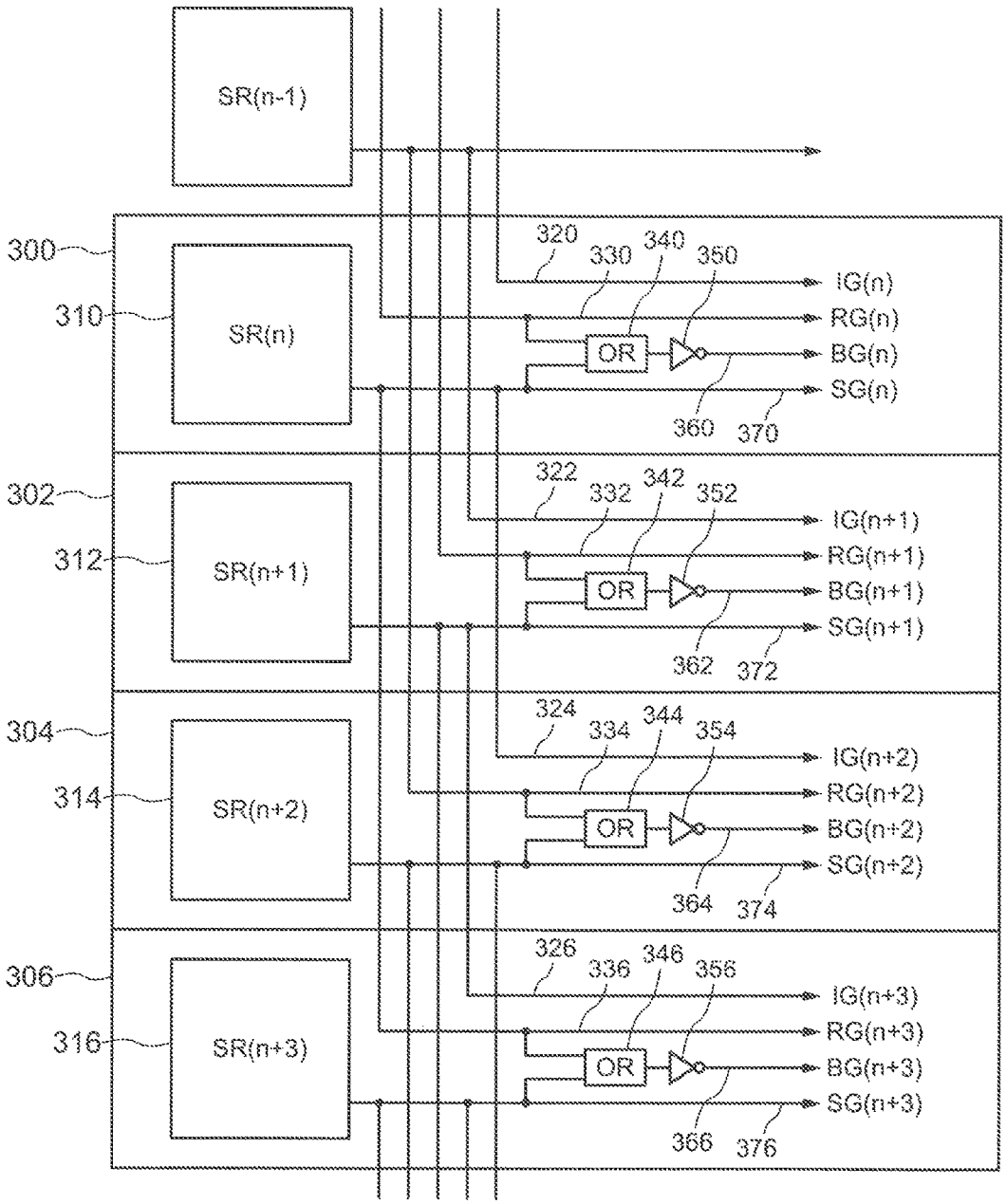
FIG. 4 is a circuit diagram showing an example of a circuit structure of a periphery circuit related to one embodiment of the present invention.

FIG. 4 is a circuit diagram showing an example of a circuit structure of a periphery circuit related to one embodiment of the present invention. A part of a periphery circuit from an nth row to n+3 row is shown in FIG. 4. As is shown in FIG. 4, shift resistors 310, 312, 314 and 316 are each arranged in periphery circuits 300, 302, 304 and 306 on n−n+3 rows respectively. The periphery circuit 300 on the nth row includes an initialization control signal line 320, reset control signal line 330, OR circuit 340, inverter 350, output control signal line 360, and pixel control signal line 370. Furthermore, the output control signal line 360 is connected to the reset control signal line 330 and pixel control signal line 370 via the OR circuit 340 and inverter 350.

Similar to the periphery circuit 300 on the nth row, the periphery circuit 302 on the n+1 row includes an initialization control signal line 322, reset control signal line 332, OR circuit 342, inverter 352, output control signal line 362, and pixel control signal line 372. The periphery circuit 304 on the n+2 row includes an initialization control signal line 324, reset control signal line 334, OR circuit 344, inverter 354, output control signal line 364, and pixel control signal line 374. The periphery circuit 306 on the n+3 row includes an initialization control signal line 326, reset control signal line 336, OR circuit 346, inverter 356, output control signal line 366, and pixel control signal line 376.

Among the four control signal lines in the periphery circuit 300 on the nth row described above, the pixel control signal line 370 is connected to the shift register 310. On the other hand, the initialization control signal line 320 and reset control signal line 330 are connected to shift registers on rows other than the nth row. The shift register 310 is connected to the initialization control signal line 324 of the n+2 row, and the reset control signal line 336 of the n+3 row. That is, the same timing signal SR (n) is supplied to the pixel control signal SG (n) of the pixel control signal line 370, the initialization control signal IG (n+2) of the initialization control signal line 324, and the reset control signal RG (n+3) of the reset control signal line 336.

Referring to FIG. 2 and FIG. 4, the nth row shift register 310 controls an nth row pixel transistor SST via the nth row pixel control signal line 370. The nth row shift register 310 controls an n+2 initialization transistor IST via the n+2 row initialization control signal line 324. The nth row shift register 310 controls an n+3 reset transistor RST via the n+3 row reset control signal line 326.

Figure 5:
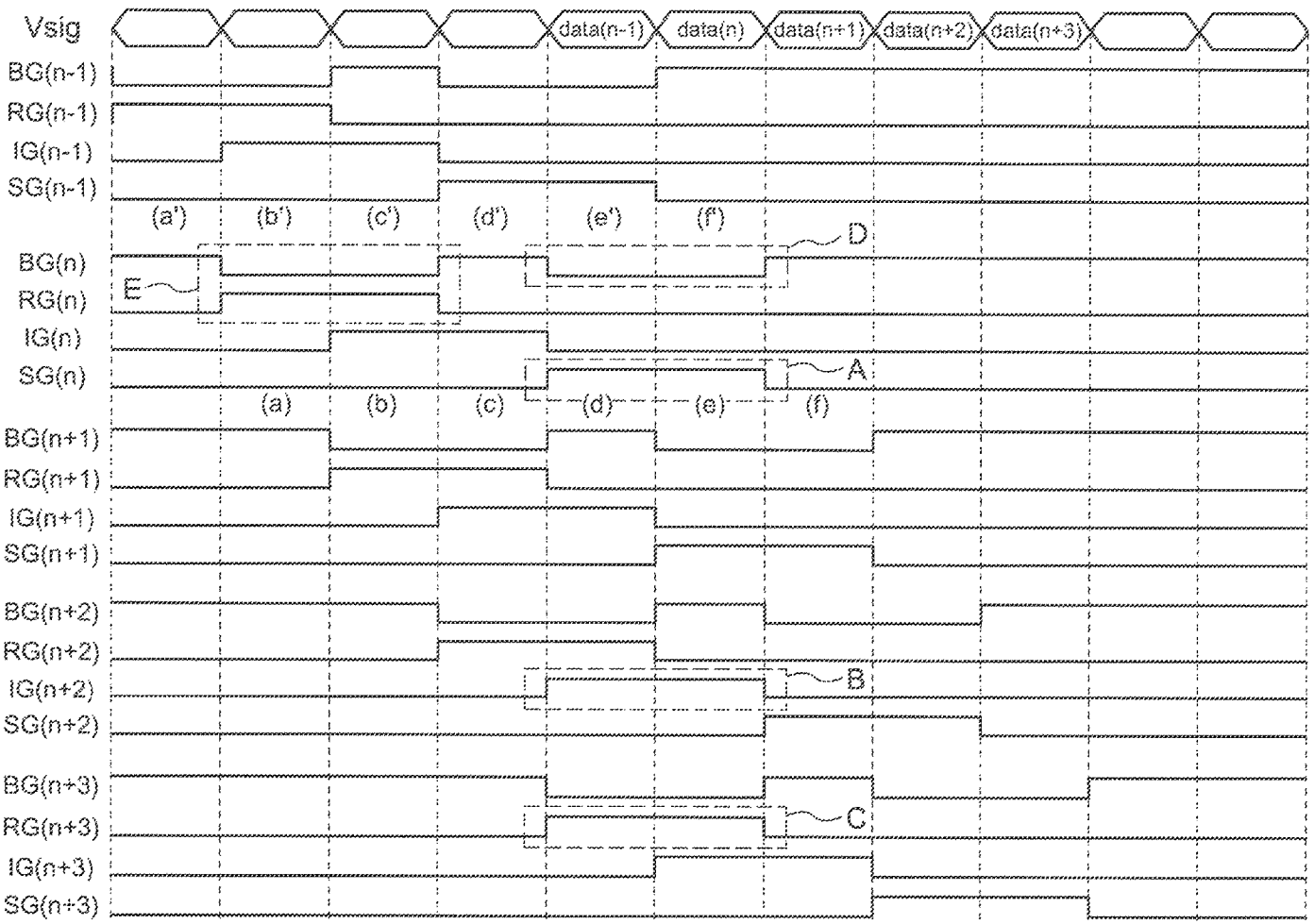
FIG. 5 is a diagram showing a timing chart illustrating a driving method of a pixel circuit on a plurality of rows related to one embodiment of the present invention.

Here, a driving method of the display device 10 using the plurality of transistors shown in FIG. 4 is explained using FIG. 5. FIG. 5 is a diagram showing a timing chart illustrating a driving method of a pixel circuit on a plurality of rows related to one embodiment of the present invention. A timing signal to be supplied to a pixel circuit from an nth row to n+3 row is shown in FIG. 5. Referring to FIG. 4, a timing signal SR (n) supplied from the nth row shift register 310 is supplied as SG (n), IG (n+2) and RG (n+3). That is, as is shown in FIG. 5, the same timing signal is supplied to SG (n), IG (n+2) and RG (n+3) (see A, B and C in FIG. 5).

Referring to FIG. 4, a timing signal supplied as SG (n) and RG (n) is supplied to BG (n) via the OR circuit 304 and inverter 350. That is, as is shown in FIG. 5, a timing signal in which RG (n) and SG (n) are inverted is supplied to BG (n) (see A, D and E in FIG. 5).

As described above, BG (n), RG (n), IG (n) and SG (n) are all supplied with two horizontal periods timing signal. Therefore, a shift register that supplies two horizontal periods timing signal may be arranged in a periphery circuit. That is, since it is not necessary to supply a timing signal including a plurality of types of period to one row, a pixel circuit is driven by arranging one type of shift register with respect to one row.

In addition, as is shown in FIG. 5, for example, a first writing period (d) of an nth row overlaps a second writing period (e') of the previous row n−1, and gradation data [data(n−1)] of row n−1 is supplied as Vsig. That is, in a first writing period (d) of an nth row, gradation data [data(n−1)] is written to a pixel circuit of row n−1. In addition, in a second writing period (e) of an nth row, gradation data [data(n)] is written to a pixel circuit of an nth row. In this way, it is possible to write to a pixel circuit of a previous row in the first writing period, and write to a pixel circuit of a the present row in the second writing period.

As described above, according to the display device 10 related to the first embodiment, it is possible to use two horizontal periods timing signal for all timing signals by which a pixel circuit is driven. In this way, since it is sufficient to arrange a shift register which supplies two horizontal periods timing signal in a periphery circuit, it is possible to reduce the area dedicated to a periphery circuit. As a result, it is possible to provide a display device which can realize a narrow frame.

In addition, by charging and discharging each auxiliary capacitor Cad and storage capacitor Cs in different reset periods respectively, the load on a reset power supply line 142 connected between an auxiliary capacitor Cad and storage capacitor Cs is dispersed in each reset period. In this way, light emission variation in a pixel circuit adjacent in a row direction is reduced. Furthermore, since the display device 10 is provided with a first writing period and second writing period, sufficient time for writing is secured. Therefore, more accurate signal writing is possible. In addition, a signal voltage of a previous row is applied to a pixel circuit in the first writing period. When a voltage signal of the present row is applied to a pixel circuit in the second writing period, a signal voltage applied to a pixel circuit varies by the amount of difference from a signal voltage of the previous row. Therefore, it is possible to avoid a large variation in a signal voltage applied to a pixel circuit.

Second Embodiment

A summary of a display device related to one embodiment of the present invention is explained using FIG. 6 to FIG. 9. In the second embodiment, an organic EL display device arranged with a threshold compensation circuit of a drive transistor is explained.

[Structure of a Display Device 10A]

Since the pixel structure of the entire display device 10A is the same as the display device 10 of the first embodiment shown in FIG. 1, an explanation is omitted here and an explanation is provided referring to FIG. 1.

Figure 6:
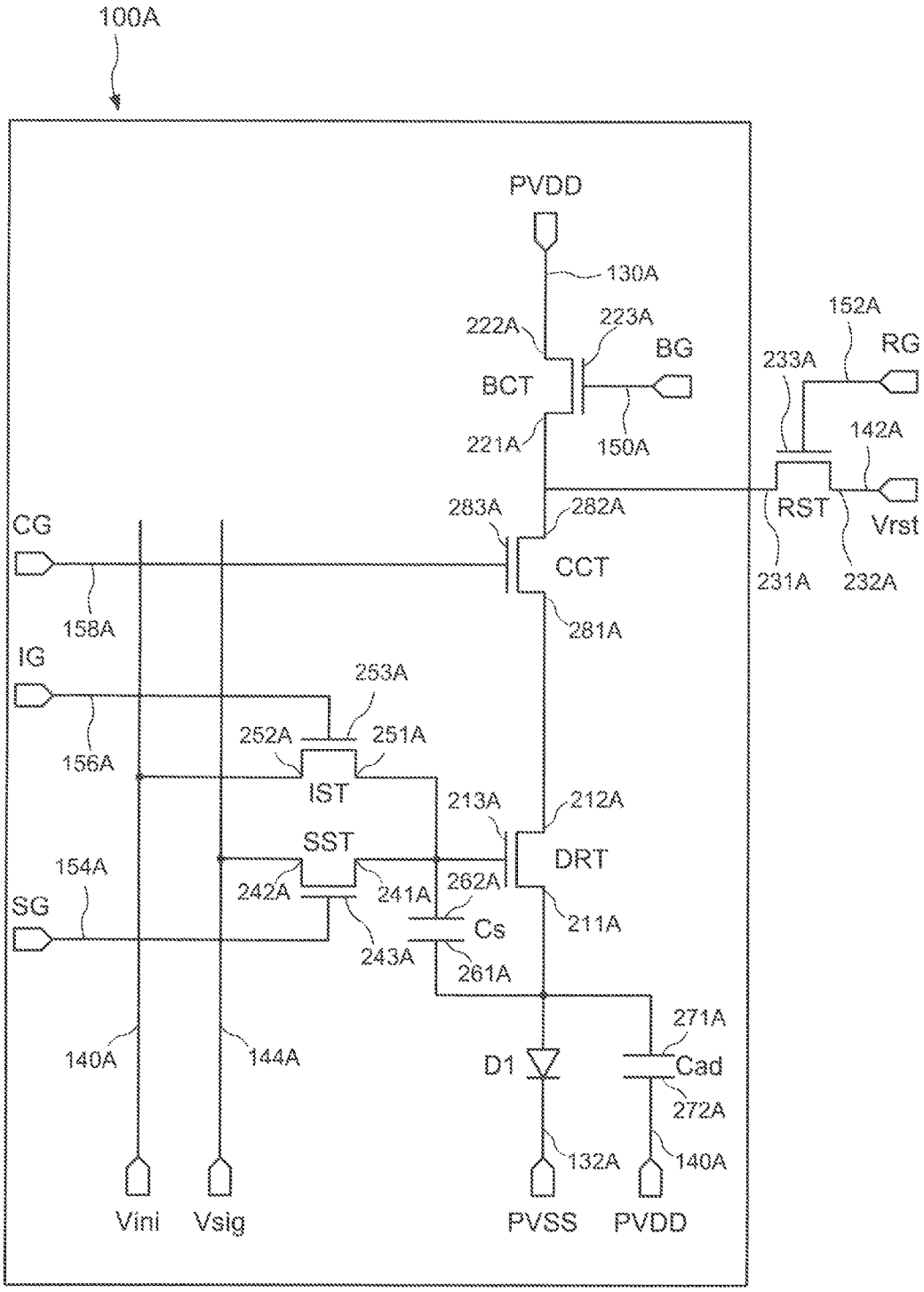
FIG. 6 is a circuit diagram showing an example of a circuit structure of a pixel circuit related to one embodiment of the present invention.

FIG. 6 is a circuit diagram showing an example of a circuit structure of a pixel circuit related to one embodiment of the present invention. All of the transistors which form the pixel circuit 100A shown in FIG. 6 are n channel type transistors. As is shown in FIG. 6, the pixel circuit 100A includes a light emitting element D1, a drive transistor DRT, a light emitting control transistor CCT, an output transistor BCT, a pixel transistor SST, an initialization transistor IST, a storage capacitor Cs, and an auxiliary capacitor Cad. In the pixel circuit 100A, for example, a reset transistor RST arranged outside of the pixel circuit 100A such as a periphery circuit is connected to the pixel circuit 100A. In the explanation herein, one of either a source and drain of a transistor is a first terminal and the other is a second terminal. In addition, one terminal of a capacitor element is called a first capacitor terminal and the other is called a second capacitor terminal.

A first terminal 211 of the drive transistor DRT is connected to an anode terminal of the light emitting element D1, a first capacitor terminal 261A of the storage capacitor Cs, and a first capacitor terminal 271A of the auxiliary capacitor Cad. A second terminal 212A is connected to a first terminal 281A of the light emitting control transistor CCT. A second terminal 282A of the light emitting control transistor CCT is connected to a first terminal 221A of the output transistor BCT and a first terminal 231A of the reset transistor RST. A second terminal 222A of the output transistor BCT is connected to a first main power supply line 130A.

A first terminal 241A of the pixel transistor SST is connected to a gate terminal 213A of the drive transistor DRT, a first terminal 251A of the initialization transistor IST, and a second capacitor terminal 262A of the storage capacitor Cs. A second terminal 242A of the pixel transistor SST is connected to a pixel data signal line 144A. A second terminal 252A of the initialization transistor IST is connected to an initialization power supply line 140A. A second capacitor terminal 272A of the auxiliary capacitor Cad is connected to the initialization power supply line 140A. A cathode terminal of the light emitting element D1 is connected to a second main power supply line 132A.

A first terminal 231A of a reset transistor RST arranged outside the pixel circuit 100A is connected to a second terminal 282A of the light emitting control transistor CCT and a first terminal 221A of the output transistor BCT as described previously. A second terminal 232A is connected to a reset power supply line 142A.

Here, a first main power supply voltage PVDD is supplied to the first main power supply line 130A. A second main power supply voltage PVSS is supplied to the second main power supply line 132A. The first main power supply voltage PVDD is applied to an anode. The second main power supply voltage PVSS is applied to a cathode. An initialization power supply voltage Vini is supplied to the initialization power supply line 140A. A reset power supply voltage Vrst is supplied to the reset power supply line 142A. Image data Vsig is supplied to the image data signal line 144A.

Furthermore, a gate terminal of 283A of the light emitting control transistor CCT is connected to a light emitting control signal line 158A. A gate terminal 223A of the output transistor BCT is connected to an output control signal line 150A. A gate terminal 243A of the pixel transistor SST is connected to a pixel control signal line 154A. A gate terminal 253A of the initialization transistor IST is connected to an initialization control signal line 156A. A light emitting control signal CG is supplied to the light emitting controls signal line 158A. An output control signal BG is supplied to the output control signal line 150A. A pixel control signal SG is supplied to the pixel control signal line 154A. An initialization control signal IG is supplied to the initialization control signal line 156A. A gate terminal 233A of the reset transistor RST is connected to the reset control signal line 152A. A reset control signal RG is supplied to the reset control signal line 152A.

In other words, the first capacitor terminal 261A of the storage capacitor Cs is connected to the first terminal 211A of the drive transistor DRT, and the second capacitor terminal 262A of the storage capacitor Cs is connected to the first terminal 241A of the image transistor SST. In addition, although a structure in which all of the transistors which form the pixel circuit 100A are n channel type transistors is exemplified in the second embodiment, the present invention is not limited to this structure. For example, all the transistors other than a drive transistor DRT which form the pixel circuit 100A may also be a p channel type transistor, or both an n channel type and p channel type transistor.

[Driving Method of the Display Device 10A]

Figure 7:
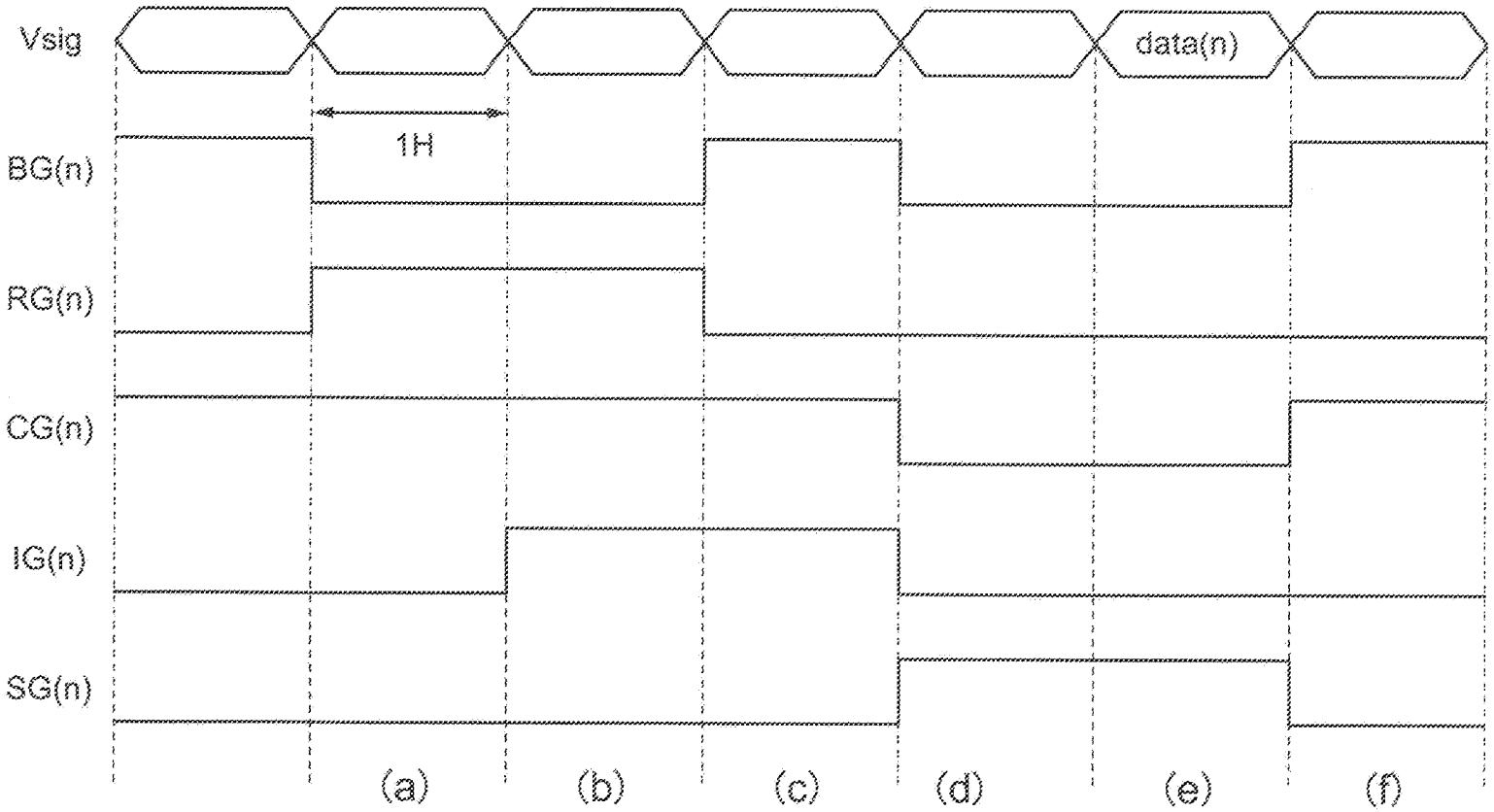
FIG. 7 is a diagram showing a timing chart illustrating a driving method of a pixel circuit related to one embodiment of the present invention.

FIG. 7 is a diagram showing a timing chart illustrating a driving method of a pixel circuit related to one embodiment of the present invention. Furthermore, in the present embodiment, all of the transistors which form a pixel circuit are n channel type transistors. That is, when a [low level] control signal is supplied to a gate terminal of a transistor, that transistor is turned OFF (non-conducting state). On the other hand, when a [high level] control signal is supplied to a gate terminal of a transistor, that transistor is turned ON (conducting state). A driving method of the display device 10A is explained below using the circuit structure in FIG. 6 and timing chart in FIG. 7. Furthermore, here an example is explained in which image data is written to an nth row pixel circuit group.

As is shown in FIG. 7, the display device 10A includes (a) a first reset period, (b) a second reset period, (c) a threshold compensation period, (d) a first writing period, (e) a second writing period and (f) a light emitting period. These periods are explained below while referring to FIG. 6 and FIG. 7. Furthermore, a period sectioned by the dotted line FIG. 7 corresponds to a horizontal period (1H). A horizontal period means a period during which an image data signal is written to all the pixel circuits on one row. Furthermore, since a summary of the operations in each period described above is similar to the first embodiment, a detailed explanation is omitted.

(a) First Reset Period

In a first reset period, an output control signal BG changes from a high level to a low level and a reset control signal RG changes from a low level to a high level. A light emitting control signal CG is maintained at a high level, and an initialization control signal IG and pixel control signal SG are maintained at a low level. That is, the light emitting control transistor CCT and reset transistor RST change to an ON state, and the output transistor BCT, pixel transistor SST and initialization transistor IST change to an OFF state. In this way, the second terminal 212A of the drive transistor DRT is supplied with a reset power supply voltage Vrst. Furthermore, the reset power supply voltage Vrst may be a voltage sufficiently high for turning on the drive transistor DRT in a first reset period. In other words, the reset power supply voltage Vrst may be a voltage obtained by adding a voltage having a margin to the threshold voltage VTH of the drive transistor DRT with respect to the second main power supply voltage PVSS.

(b) Second Reset Period

In the second reset period, an initialization control signal IG changes from a low level to a high level. An output control signal BG and pixel control signal SG are maintained at a low level and a reset control signal RG and light emitting control signal CG are maintained at a high level. That is, the reset transistor RST, light emitting control transistor CCT, and initialization transistor IST change to an ON state, and the output transistor BCT and pixel transistor SST change to an OFF state. In this way, a reset power supply voltage Vrst is supplied to the second terminal 212A of the drive transistor DRT, and an initialization power supply voltage Vini is supplied to the gate terminal 213A of the drive transistor DRT and the second capacitor terminal 262A of the storage capacitor Cs.

Here, a voltage which changes the drive transistor DRT to an ON state is supplied to the reset power supply voltage Vrst and initialization power supply voltage Vini. Therefore, a reset power supply voltage Vrst is supplied via the drive transistor DRT to the first terminal 211A and the first capacitor terminal 261A of the storage capacitor Cs.

(c) Threshold Compensation Period

In a threshold compensation period, an output control signal BG changes from a low level to a high level and a reset control signal RG changes from a high level to a low level. A light emitting control signal CG and initialization control signal IG are maintained at a high level, and a pixel control signal SG is maintained at a low level. That is, the output transistor BCT, light emitting control transistor CCT, and initialization transistor IST change to an ON state, and the reset transistor RST and pixel transistor SST change to an OFF state.

Here, since the drive transistor DRT is in an ON state in the second reset period described above, a current supplied from the first main power supply voltage PVDD flows to the first terminal 211A from the second terminal 212A of the drive transistor DRT. The potential of the first terminal 211A increases due to this current. In addition, when a difference between the potential of the first terminal 211A and the potential of the gate terminal 213A reaches the threshold voltage (VTH) of the drive transistor DRT, the drive transistor DRT changes to an OFF state.

Here, since Vini is supplied to the gate terminal 213A, when the potential the first terminal 211A reaches (Vini-VTH), the drive transistor DRT changes to an OFF state. At this time, since Vini is supplied to the second capacitor terminal 262A of the storage capacitor Cs and (Vini-VTH) is supplied to first capacitor terminal 261A, a charge based on VTH is held in the storage capacitor Cs. In other words, in a threshold compensation period, data based on VTH of the drive transistor DRT is stored in the storage capacitor Cs.

(d) First Writing Period

In the first writing period, an output control signal BG, light emitting control signal CG and an initialization control signal IG change from a high level to a low level and a pixel control signal SG changes from a low level to a high level. A reset control signal RG is maintained at a low level. That is, the pixel transistor SST changes to an ON state, and the output transistor BCT, reset transistor RST, light emitting control transistor CCT and initialization transistor IST change to an OFF state. In this way, in the first writing period, a pixel circuit changes to a state where it is possible to supply image data Vsig to the gate terminal 213A of the drive transistor DRT. Here, in the second embodiment, image data Vsig corresponding to a pixel 100A on the present row is not supplied but image data Vsig corresponding to a pixel 100A on the previous row is supplied to an image data signal line 144A in the first writing period.

(e) Second Writing Period

In the second writing period, gradation data [data(n)] is supplied as image data Vsig to the image data signal line 144A. Furthermore, the level (high level or low level) of an output control signal BG, reset control signal RG, light emitting control signal CG, initialization control signal IG and pixel control signal SG in the second writing period is the same as in the first writing period. In this way, gradation data [data(n)] is supplied via the pixel transistor SST to the gate terminal 213A of the drive transistor DRT and the second capacitor terminal 262A of the storage capacitor Cs. At this time, the potential difference (Vgs) between a potential of the first terminal 211A of the drive transistor DRT and a potential of the gate terminal 213A is expressed in the formula (2) described above.

(f) Light Emitting Period

In the light emitting period, an output control signal BG and light emitting control signal CG change from a low level to a high level and a pixel control signal SG changes from a high level to a low level. The reset transistor RST and initialization transistor IST are maintained in an OFF state. That is, the output transistor BCT and light emitting control transistor CCT change to an ON state, and the reset transistor RST, initialization transistor IST and pixel transistor SST change to an OFF state. In this way, the drive transistor DRT provides a current based on the formula (2) described above to the light emitting element D1 among the first main power supply voltages PVDD supplied to the second terminal 212A.

Here, a current (Id) flowing through the drive transistor DRT is expressed by the formula (4) described above. That is, Id changes to a current which is not dependent on VTH.

As described above, in the light emitting period, a current with the effects of VTH of the drive transistor DRT removed is supplied to the light emitting element D1. That is, a current compensated for VTH of the drive transistor DRT is supplied to the light emitting element D1.

As is shown in FIG. 7, in the display device 10A, a high level signal of a horizontal period is supplied in each of a first reset period and second reset period. Since a first reset period and second reset period are continuous, a high level signal of two horizontal periods is supplied to the reset control signal RG. In other words, an ON signal of two horizontal periods is supplied to the gate terminal 233A of the reset transistor RST. A high level signal of a horizontal period is supplied in each of the first writing period and second writing period. Since the first writing period and second writing period are continuous, a high level signal of two horizontal periods is supplied to the pixel control signal SG. That is, an ON signal of two horizontal periods is supplied to the gate terminal 243A of the pixel transistor SST.

Although described later, in the first writing period described above, image data writing is not performed in a drive transistor DRT on the present row (nth row) but image data Vsig is written to a drive transistor DRT on the previous row (n−1 row). However, in the first writing period, image data writing may also be performed to a drive transistor DRT on rows other than an n−1 row.

[Circuit Structure of a Periphery Circuit in Display Device 10A]

Figure 8:
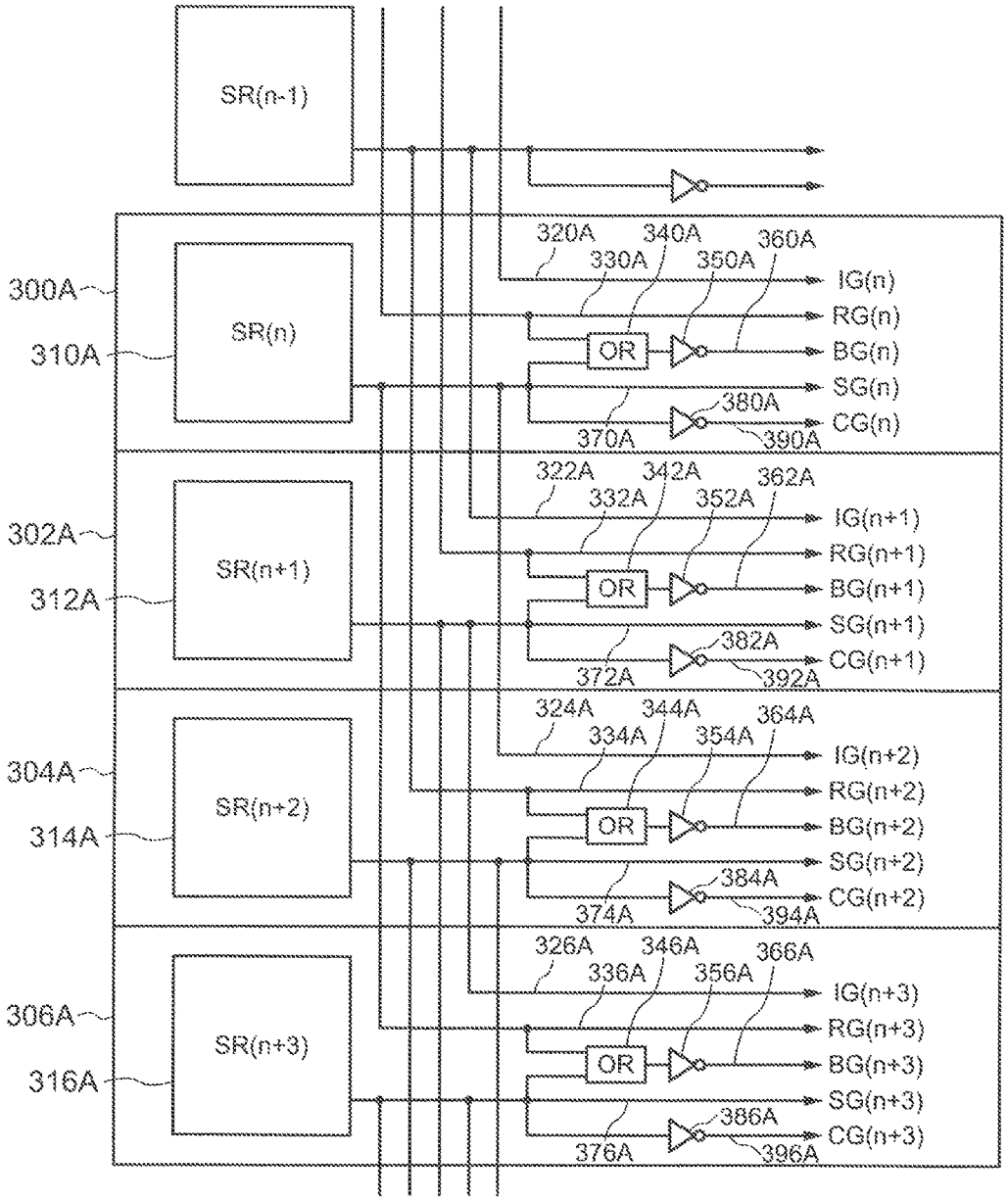
FIG. 8 is a circuit diagram showing an example of a circuit structure of a periphery circuit related to one embodiment of the present invention.

FIG. 8 is a circuit diagram showing an example of a circuit structure of a periphery circuit related to one embodiment of the present invention. A part of a periphery circuit from an nth row to n+3 row is shown in FIG. 8. As is shown in FIG. 8, shift resistors 310A, 312A, 314A and 316A are each arranged in periphery circuits 300A, 302A, 304A and 306A on n−n+3 rows respectively. The periphery circuit 300A on the nth row includes an initialization control signal line 320A, reset control signal line 330A, OR circuit 340A, inverter 350A, output control signal line 360A, pixel control signal line 370A, inverter 380A and light emitting control signal line 390A. Furthermore, the output control signal line 360A is connected to the reset control signal line 330A and pixel control signal line 370A via the OR circuit 340A and inverter 350A. In addition, the light emitting control signal line 390A is connected to the pixel control signal line 370A via the inverter 380A.

Similar to the periphery circuit 300A on the nth row, the periphery circuit 302A on the n+1 row includes an initialization control signal line 322A, reset control signal line 332A, OR circuit 342A, inverter 352A, output control signal line 362A, pixel control signal line 372A, inverter 382A and light emitting control signal line 392A. The periphery circuit 304A on the n+2 row includes an initialization control signal line 324A, reset control signal line 334A, OR circuit 344A, inverter 354A, output control signal line 364A, pixel control signal line 374A, inverter 384A and light emitting control signal line 394A. The periphery circuit 306A on the n+3 row includes an initialization control signal line 326A, reset control signal line 336A, OR circuit 346A, inverter 356A, output control signal line 366A, pixel control signal line 376A, inverter 386A and light emitting control signal line 396A.

Among the five control signal lines in the periphery circuit 300A on the nth row described above, the pixel control signal line 370A and light emitting control line 390A are connected to the shift register 310A. The initialization control signal line 320A and reset control signal line 330A are connected to shift registers on rows other than the nth row. The shift register 310A is connected to the initialization control signal line 324A of the n+2 row, and the reset control signal line 336A of the n+3 row. That is, the same timing signal SR (n) is supplied to the pixel control signal SG (n) of the pixel control signal line 370A, the initialization control signal IG (n+2) of the initialization control signal line 324A, and the reset control signal RG (n+3) of the reset control signal line 336A.

Referring to FIG. 6 and FIG. 8, the nth row shift register 310A controls an nth row pixel transistor SST via the nth row pixel control signal line 370A. The nth row shift register 310A controls an n+2 initialization transistor IST via the n+2 row initialization control signal line 324A. The nth row shift register 310A controls an n+3 reset transistor RST via the n+3 row reset control signal line 326A.

Figure 9:
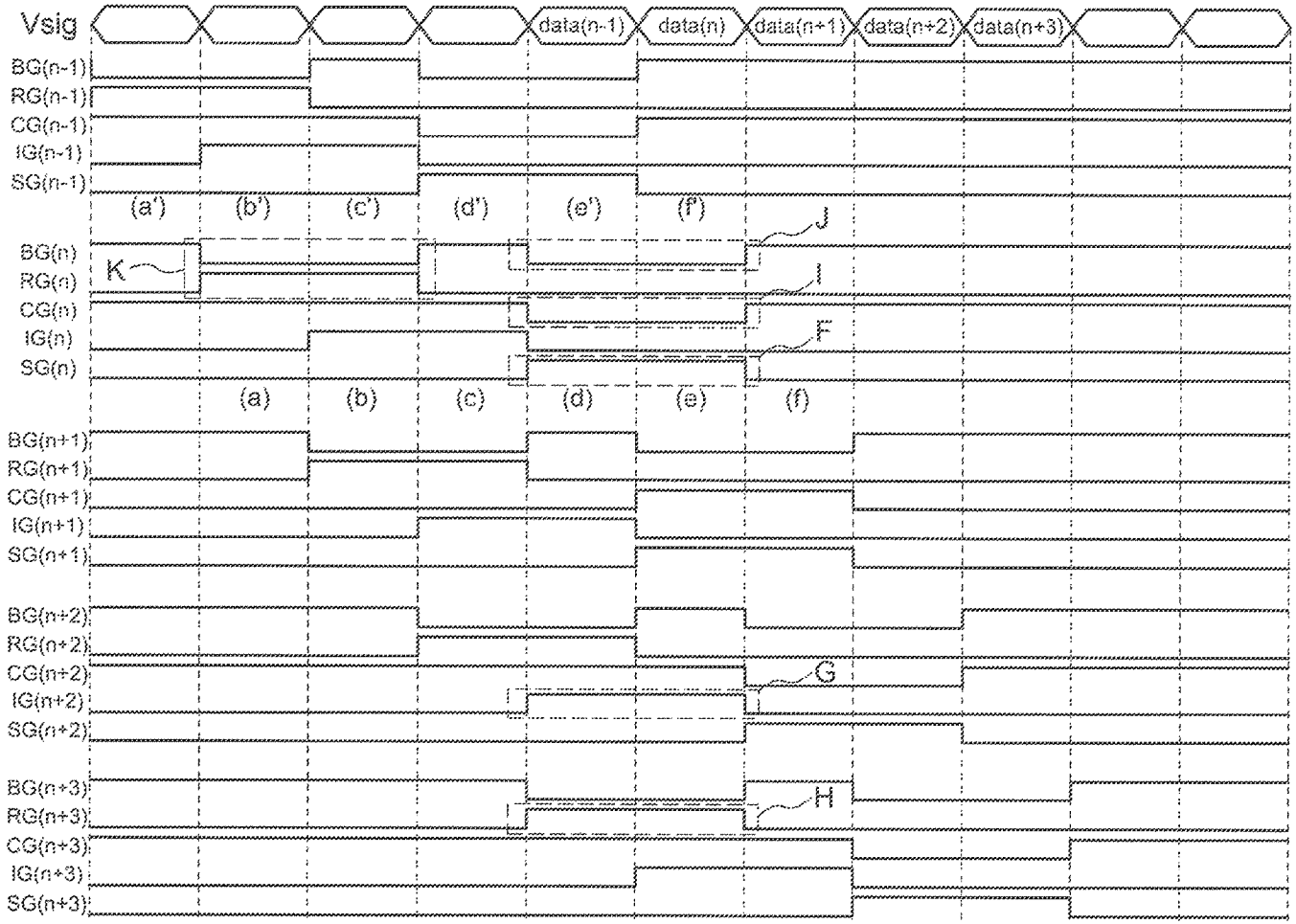
FIG. 9 is a diagram showing a timing chart illustrating a driving method of a pixel circuit on a plurality of rows related to one embodiment of the present invention.

Here, a driving method of the display device 10A using the plurality of transistors shown in FIG. 8 is explained using FIG. 9. FIG. 9 is a diagram showing a timing chart illustrating a driving method of a pixel circuit on a plurality of rows related to one embodiment of the present invention. A timing signal to be supplied to a pixel circuit from an nth row to n+3 row is shown in FIG. 9. Referring to FIG. 9, a timing signal SR (n) supplied from the nth row shift register 310A is supplied as SG (n), IG (n+2) and RG (n+3). That is, as is shown in FIG. 9, the same timing signal is supplied to SG (n), IG (n+2) and RG (n+3) (see F, G and H in FIG. 9).

Referring to FIG. 8, a timing signal supplied as SG (n) is supplied to CG (n) via the inverter 380A. That is, as is shown in FIG. 9, a timing signal in which SG (n) is inverted is supplied to CG (n) (see F and I in FIG. 9). A timing signal supplied as SG (n) and RG (n) is supplied to BG (n) via the OR circuit 340A and the inverter 350A. That is, as is shown in FIG. 9, a timing signal in which RG (n) and SG (n) are inverted is supplied to BG (n) (see F, J and K in FIG. 5).

As described above, BG (n), RG (n), CG (n), IG (n) and SG (n) are all supplied with two horizontal periods timing signal. Therefore, a shift register that supplies two horizontal periods timing signal may be arranged in a periphery circuit. That is, since it is not necessary to supply a timing signal including a plurality of types of period to one row, a pixel circuit is driven by arranging one type of shift register with respect to one row.

In addition, as is shown in FIG. 9, for example, a first writing period (d) of an nth row (present row) overlaps a second writing period (e') of the previous row n−1, and gradation data [data(n−1)] of row n−1 is supplied as Vsig. That is, in a first writing period (d) of an nth row, gradation data [data(n−1)] is written to a pixel circuit of row n−1. In addition, in a second writing period (e) of an nth row, gradation data [data(n)] is written to a pixel circuit of an nth row. In this way, it is possible to write to a pixel circuit of a previous row in the first writing period, and write to a pixel circuit of a the present row in the second writing period.

As described above, according to the display device 10A related to the second embodiment, it is possible to use two horizontal periods timing signal for all timing signals by which a pixel circuit is driven. In this way, since it is sufficient to arrange a shift register which supplies two horizontal periods timing signal in a periphery circuit, it is possible to reduce the area dedicated to a periphery circuit. As a result, it is possible to provide a display device which can realize a narrow frame.

In addition, by charging and discharging each auxiliary capacitor Cad and storage capacitor Cs in different reset periods respectively, the load on a reset power supply line 142A connected between an auxiliary capacitor Cad and storage capacitor Cs is dispersed in each reset period. In this way, light emission variation in a pixel circuit adjacent in a row direction is reduced. Furthermore, since the display device 10A is provided with a first writing period and second writing period, sufficient time for writing is secured. Therefore, more accurate signal writing is possible. In addition, a signal voltage of a previous row is applied to a pixel circuit in the first writing period. When a voltage signal of the present row is applied to a pixel circuit in the second writing period, a signal voltage applied to a pixel circuit varies by the amount of difference from a signal voltage of the previous row. Therefore, it is possible to avoid a large variation in a signal voltage applied to a pixel circuit.

Furthermore, the present invention is not limited to the embodiments described above, and appropriate modifications may be made that do depart from the scope of the present invention.

What is claimed is:

1. A display device comprising:

a plurality of pixels arranged in a row direction and a column direction, each of the plurality of pixels including a light emitting element;

a drive transistor having a source and drain, one of the source and drain of the drive transistor being connected to the light emitting element;

a first switching element having a source and drain, one of the source and drain of the first switching element being connected to the other of the source and drain of the drive transistor, and the other being connected to a main power supply line;

a second switching element having a source and drain, one of the source and drain of the second switching element being connected to the one of the source and drain of the drive transistor, and the other being connected to a reset power supply line;

a third switching element having a source and drain, one of the source and drain of the third switching element being connected to a gate terminal of the drive transistor, and the other being connected to a first signal line;

a fourth switching element having a source and drain, one of the source and drain of the fourth switching element being connected to the one of the source and drain of the third switching element, and the other being connected to an initialization power supply line; and a capacitor element having two electrodes, one electrode being connected to the one of the source and drain of the drive transistor, and the other electrode being connected to the one of the source and drain of the third switching element;

wherein two horizontal periods ON signal is supplied to a gate terminal of each of the second switching element, third switching element and fourth switching element respectively, the display device includes a first reset period, a second reset period, a threshold compensation period, and a writing period;

in the first reset period, the first switching element is in an OFF state, the second switching element is in an ON state, the third switching element is in an OFF state, and the fourth switching element is in an OFF state, in the second reset period, the first switching element is in an OFF state, the second switching element is in an ON state, the third switching element is in an OFF state, and the fourth switching element is in an ON state, in the threshold compensation period, the first switching element is in an ON state, the second switching element is in an OFF state, the third switching element is in an OFF state, and the fourth switching element is in an ON state, and in the writing period, the first switching element is in an OFF state, the second switching element is in an OFF state, the third switching element is in an ON state, and the fourth switching element is in an OFF state.

2. The display device according to claim 1, further comprising:

a plurality of shift resistors arranged in each row;

wherein a shift resistor on an nth row controls the third switching element on an nth row, the fourth switching element on an n+2 row, and the second switching element on an n+3 row.

3. The display device according to claim 2, further comprising:

an OR circuit;

an inverter; and a second signal line being connected to a gate terminal of the first switching element;

wherein the OR circuit is connected to the second signal line via the inverter.

4. The display device according to claim 3, wherein the OR circuit on the nth row is connected to the shift register on the nth row and the shift register on an n+3 row.

5. The display device according to claim 3, further comprising:

a third signal line being connected to a gate terminal of the second switching element; and a fourth signal line being connected to a gate terminal of the third switching element; wherein the OR circuit is connected to the third signal line and the fourth signal line.

6. The display device according to claim 1, wherein the display device includes the first reset period for supplying a reset voltage supplied to the reset power supply line to the one of the source and drain of the drive transistor, the second reset period for supplying an initialization voltage reset signal supplied to the initialization power supply line to gate terminal of the drive transistor;

the threshold compensation period for blocking the reset voltage supplied to the one of the source and drain of the drive transistor, supplying a main voltage supplied to the main power supply line to the other of the source and drain of the drive transistor, and holding a charge based on a threshold voltage of the drive transistor in the capacitor element, and the writing period for blocking the main voltage supplied to the other of the source and drain of the drive transistor, and the initialization voltage supplied to the gate terminal of the drive transistor, supplying a signal voltage supplied to the first signal line to the gate terminal of the drive transistor, and holding a charge based on the threshold voltage and the signal voltage in the capacitor element.

7. A display device comprising:

a plurality of pixels arranged in a row direction and a column direction, each of the plurality of pixels including a light emitting element;

a drive transistor having a source and drain, one of the source and drain of the drive transistor being connected to the light emitting element;

a first switching element having a source and drain, one of the source and drain of the first switching element being connected to the other of the source and drain of the drive transistor, and the other being connected to a main power supply line;

a second switching element having a source and drain, one of the source and drain of the second switching element being connected to the other of the source and drain of the drive transistor, and the other being connected to a reset power supply line;

a third switching element having a source and drain, one of the source and drain of the third switching element being connected to a gate terminal of the drive transistor, and the other being connected to a signal line;

a fourth switching element having a source and drain, one of the source and drain of the fourth switching element being connected to the one of the source and drain of the third switching element, and the other being connected to an initialization power supply line; and a capacitor element having two electrodes, one electrode being connected to the one of the source and drain of the drive transistor, and the other electrode being connected to either the source and drain of the third switching element;

wherein the other of the source and drain of the first switching element and the one of the source and drain of the second switching element are connected to the reset power supply line via a fifth switching element; and two horizontal periods ON signal is supplied to a gate terminal of each of the third switching element, fourth switching element and fifth switching element respectively.

8. The display device according to claim 7, further comprising:

a plurality of shift resistors arranged in each row;

wherein a shift resistor on an nth row controls the third switching element on an nth row, the fourth switching element on an n+2 row, and the fifth switching element on an n+3 row.

9. The display device according to claim 7, wherein the display device includes a first reset period, a second reset period, a threshold compensation period, and a writing period;

in the first reset period, the first switching element is in an ON state, the second switching element is in an OFF state, the third switching element is in an OFF state, the fourth switching element is in an OFF state, and the fourth switching element is in an ON state, in the second reset period, the first switching element is in an ON state, the second switching element is in an OFF state, the third switching element is in an OFF state, the fourth switching element is in an ON state, and the fifth switching element is in an ON state in the threshold compensation period, the first switching element is in an ON state, the second switching element is in an ON state, the third switching element is in an OFF state, the fourth switching element is in an ON state, and the fifth switching element is in an OFF state, and in the writing period, the first switching element is in an OFF state, the second switching element is in an OFF state, the third switching element is in an ON state, the fourth switching element is in an OFF state, and the fifth switching element is in an OFF state.

10. The display device according to claim 7, wherein the display device includes a first reset period for supplying a reset voltage supplied to the reset power supply line to the other of the source and drain of the drive transistor, a second reset period for supplying an initialization voltage supplied to the initialization power supply line to a gate terminal of the drive transistor;

a threshold compensation period for blocking the reset voltage supplied to the other of the source and drain of the drive transistor, supplying a main voltage supplied to the main power supply line to the other of the source and drain of the drive transistor, and holding a charge based on a threshold voltage of the drive transistor in the capacitor element, and a writing period for blocking the main voltage supplied to the other of the source and drain of the drive transistor, and the initialization voltage supplied to the gate terminal of the drive transistor, supplying a signal voltage supplied to the signal line to the gate terminal of the drive transistor, and holding a charge based on the threshold voltage and the signal voltage in the capacitor element.

11. A display device comprising:

a plurality of pixels arranged in a row direction and a column direction, each of the plurality of pixels including a light emitting element;

a drive transistor including a first terminal, a second terminal and a first gate terminal, the first terminal being connected to the light emitting element;

a first switching element including a third terminal, a fourth terminal and a second gate terminal, the third terminal being connected to the second terminal and the fourth terminal being connected to a main power supply line;

a second switching element including a fifth terminal, a sixth terminal and a third gate terminal, the fifth terminal being connected to the first terminal and the sixth terminal being connected to a reset power supply line;

a third switching element including a seventh terminal, an eighth terminal and a fourth gate terminal, the seventh terminal being connected to the first gate terminal and the eighth terminal being connected to a signal line;

a fourth switching element including a ninth terminal, a tenth terminal and a fifth gate terminal, the ninth terminal being connected to the seventh terminal and the tenth terminal being connected to an initialization power supply line; and a capacitor including a first capacitor terminal and a second capacitor terminal, the first capacitor terminal being connected to the first terminal, and the second terminal being connected to the seventh terminal;

wherein the third gate terminal, fourth gate terminal and fifth gate terminal are each supplied with two horizontal periods ON signal respectively, the display device includes a first reset period, a second reset period, a threshold compensation period, and a writing period, in the first reset period, the first switching element is in an OFF state, the second switching element is in an ON state, the third switching element is in an OFF state, and the fourth switching element is in an OFF state, in the second reset period, the first switching element is in an OFF state, the second switching element is in an ON state, the third switching element is in an OFF state, and the fourth switching element is in an ON state, in the threshold compensation period, the first switching element is in an ON state, the second switching element is in an OFF state, the third switching element is in an OFF state, and the fourth switching element is in an ON state, and in the writing period, the first switching element is in an OFF state, the second switching element is in an OFF state, the third switching element is in an ON state, and the fourth switching element is in an OFF state.

12. The display device according to claim 11, further comprising:

a plurality of shift resistors arranged in each row;

wherein a shift resistor on an nth row controls the third switching element on an nth row, the fourth switching element on an n+2 row, and the second switching element on an n+3 row.

13. The display device according to claim 11, wherein the first reset period is a period for supplying a reset voltage supplied to the reset power supply line to the first terminal, the second reset period is a period for supplying an initialization voltage supplied to the initialization power supply line to the first gate terminal;

the threshold compensation period is a period for blocking the reset voltage supplied to the first terminal, supplying a main voltage supplied to the main power supply line to the second terminal, and holding a charge based on a threshold voltage of the drive transistor in the capacitor element, and the writing period is a period for blocking the main voltage supplied to the second terminal, and the initialization voltage supplied to the first gate terminal, supplying a signal voltage supplied to the signal line to the first gate terminal, and holding a charge based on the threshold voltage and the signal voltage in the capacitor element.

* * * * *